US007377067B2

(12) United States Patent
Werner

(10) Patent No.: US 7,377,067 B2
(45) Date of Patent: May 27, 2008

(54) TRIGGER SAFETY DEVICE FOR FIREARMS

(75) Inventor: Martin Werner, Elchingen (DE)

(73) Assignee: Carl Walther GmbH (DE)

( * ) Notice: Subject to any disclaimer, the term of this patent is extended or adjusted under 35 U.S.C. 154(b) by 79 days.

(21) Appl. No.: 11/409,930

(22) Filed: Apr. 24, 2006

(65) Prior Publication Data

US 2007/0039223 A1 Feb. 22, 2007

(30) Foreign Application Priority Data

May 3, 2005 (DE) ..... 10 2005 020 562

(51) Int. Cl.
*F41A 17/00* (2006.01)

(52) U.S. Cl. ..... 42/70.07

(58) Field of Classification Search ..... 42/70.06, 42/70.07

See application file for complete search history.

(56) References Cited

U.S. PATENT DOCUMENTS 2,657,490 A * 11/1953 Browning ..... 42/70.06
5,024,017 A * 6/1991 Nishioka ..... 42/70.07
2002/0014030 A1* 2/2002 Parker ..... 42/70.07

* cited by examiner

*Primary Examiner*—Michael J. Carone
*Assistant Examiner*—Gabriel J Klein
(74) *Attorney, Agent, or Firm*—Bachman & LaPointe, P.C.

(57) ABSTRACT

For a trigger safety device 100 for firearms comprising a trigger 110 which is adapted for rotary reciprocation about a fulcrum 111 and whose free end is protected by a trigger guard 120, accidental firing is prevented in that a safety slide 130 is mounted on the trigger guard 120 for reciprocal displacement between a first end position 122 and a second end position 123 such that said trigger 110 is freely pivotal in a first end position 122 of the safety slide 130 and is blocked in a second end position 123 of the safety slide 130 respectively.

14 Claims, 2 Drawing Sheets

Fig. 1
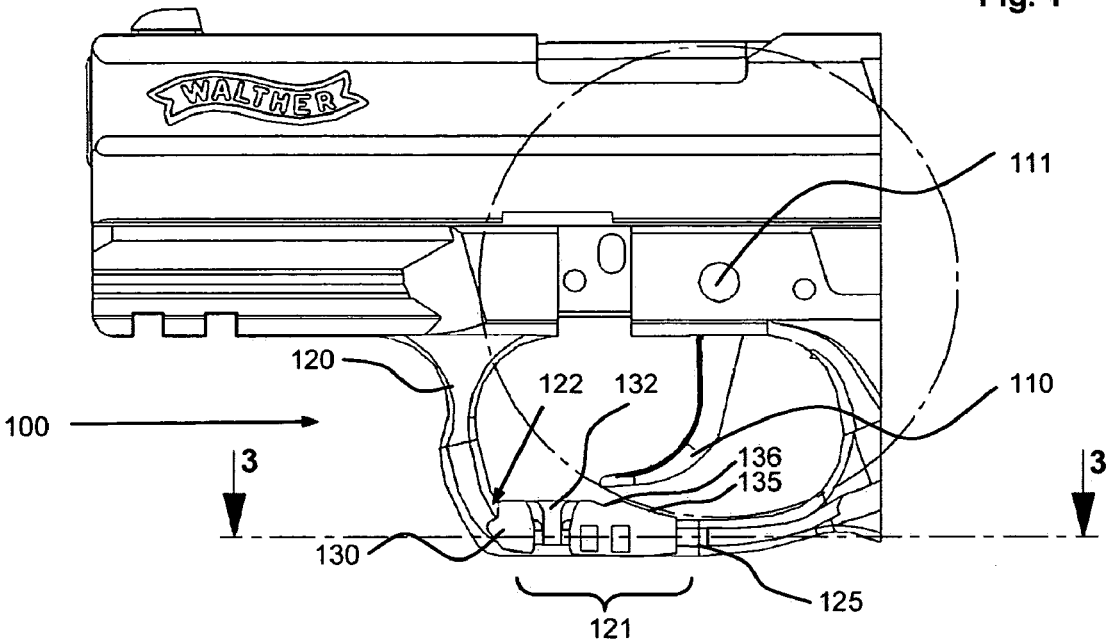
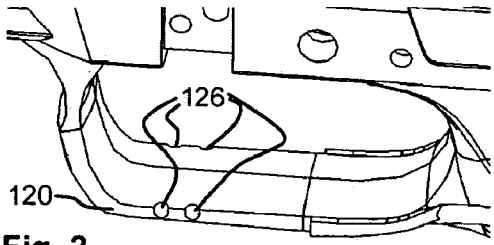
Fig. 2
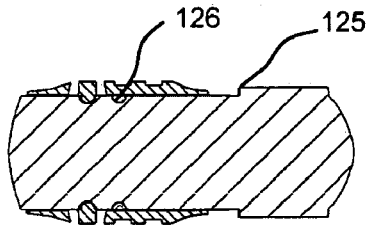
Fig. 3
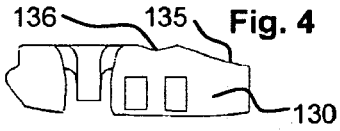
Fig. 4
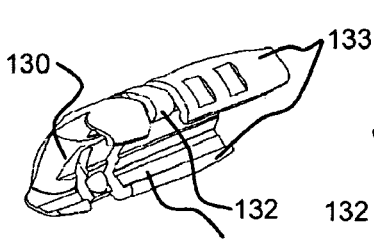
Fig. 5
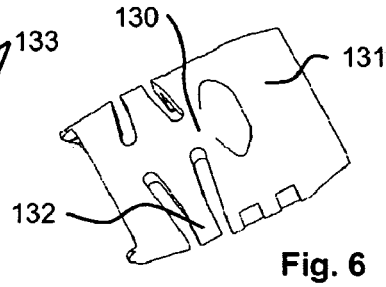
Fig. 6

TRIGGER SAFETY DEVICE FOR FIREARMS

BACKGROUND AND SUMMARY OF THE INVENTION

The invention relates to a trigger safety device for firearms comprising a trigger capable of reciprocal pivotal motion about a fulcrum, and a trigger guard which protects the free end of the trigger.

Devices of the aforementioned type are available in a variety of embodiments in the prior art and they are employed to prevent a shot from being fired when a firearm is dropped accidentally, for example. The known devices suffer from the drawback that they are not suitable for retrofitting.

It is thus an object of the invention to provide a trigger safety device that ensures that a firearm will not fire a shot by accident. Advantageously, the device may be retrofitted to a firearm.

For a device as described above, this object is achieved in that a safety slide is mounted for reciprocation between first and second end positions on the trigger guard, such that the trigger can be freely pivoted in a first end position of the safety slide while it is blocked in the second end position of the safety slide.

Preferred embodiments of the invention are the subject matter of the secondary claims and may be combined or separately implemented, as appropriate.

With the device of the invention, the combination of features comprising mounting a safety slide for reciprocal displacement between a first and a second position (e.g., end positions) and adapting the trigger such that it can pivot freely in a first end position of the safety slide but will be blocked in a second end position thereof is achieved. Blockage of the trigger may be caused by a specially designed, standardized, and refittable safety element, i.e., said safety slide, with only small interventions being necessary in the region of the trigger of the weapon for the purpose of installing such locking devices.

According to a first preferred embodiment of the device of the invention, the trigger guard has a linear configuration in the region in which the safety slide is displaceable.

In another preferred embodiment of the device of the invention provision is made for locking means to be mounted on the trigger guard for interaction with corresponding locking elements on the safety slide for locking the same in its first or second end position respectively. For example, such locking elements may be in the form of indentations on the trigger guard. Preferably, there are provided two opposing indentations located on opposite sides of the trigger guard for each of the two end positions of the safety slide.

According to another preferred embodiment of the device of the invention, provision is made for a locking element on the safety slide to be embodied as a resilient spring. The safety slide is preferably provided with two latch springs, each of which is assigned to a front and rear indentation on the trigger guard to define the front and rear end positions of the safety slide respectively. Additionally, the first and second end positions of the safety slide are defined by stop edges on the trigger guard.

According to another preferred embodiment, provision is made for the safety slide to have a top surface to which two side elements are attached, there being provided, on the inside of each side element, a guide rail to guide the movement of the safety slide along the trigger guard. The side elements are preferably of a resilient nature in order to allow the safety slide to be snapped onto the trigger guard manually and to permit manual removal of the safety slide from the trigger guard.

Generally speaking, the safety slide preferably features a profiled surface so that the trigger can move freely in the first position of the safety slide and is blocked by the safety slide in the second end position thereof.

To this end, the safety slide preferably has a curved surface profile that is designed to permit free pivotal movement of the trigger when the safety slide is in its first end position. Additionally, the surface profile of the safety slide preferably has a wedge-shaped surface portion which is constructed in such a manner that pivotal movement of the trigger is blocked when the safety slide is in its second end position.

In accordance with a preferred embodiment, the wedge-shaped portion of the surface of the safety slide is disposed between the curved surface profile and the locking elements.

BRIEF DESCRIPTION OF THE DRAWINGS

The device of the invention is described below with reference to a preferred embodiment illustrated in the drawings, in which:

FIG. 1 is a side view of the device of the invention in a preferred embodiment, in which the first end position allows for free movement of the trigger of a handgun, FIG. 2 is the trigger guard of the handgun with no safety slide, as viewed obliquely from above, FIG. 3 is cross-sectional view of the trigger guard of the handgun of FIG. 1 taken along line 3-3 and showing the safety slide in its first end position allowing free movement of the trigger, FIG. 4 is a side view of the safety slide of the preferred embodiment of the device of the invention illustrated in FIG. 1, FIG. 5 is an oblique view from below of the preferred embodiment of the device of the invention illustrated in FIG. 1, FIG. 6 is an oblique view from above of the preferred embodiment of the device of the invention illustrated in FIG. 1.

DETAILED DESCRIPTION

Figure 7:
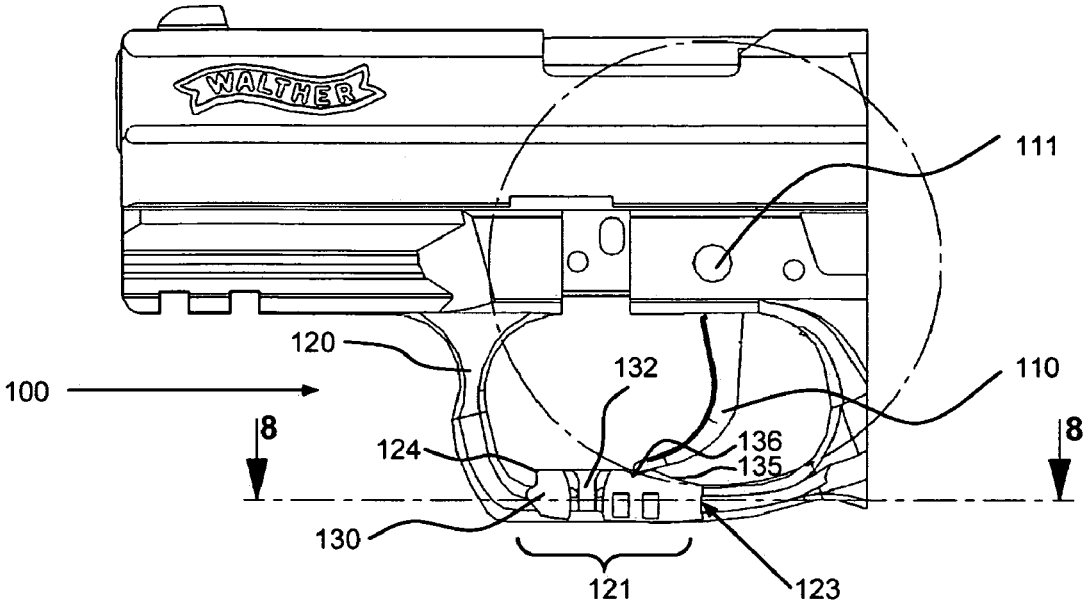
FIG. 7 is a side view of the preferred embodiment of the device of the invention as illustrated in FIG. 1 and demonstrating the second end position blocking the trigger of a handgun.
Figure 8:
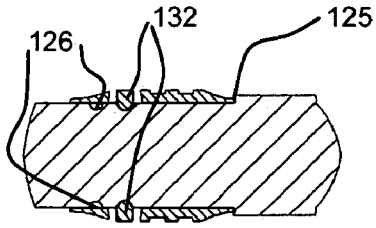
FIG. 8 is a cross-sectional view of the trigger guard of the handgun of FIG. 7 taken along line 8-8. Like reference numbers and designations in the various drawings indicate like elements.

The trigger safety device for firearms, as proposed herein and illustrated in FIGS. 1 to 8, features a trigger 110 which is reciprocally mounted for pivoting about a fulcrum 111, with its free end protected by a trigger guard 120. The essence of the invention is the displaceable safety slide 130 attached to the trigger guard 120 and capable of reciprocation between a first end position 122 and a second end position 123 such that the trigger 120 is free to pivot in the first end position 122 of the safety slide 130 and is blocked in the second end position 130 of the safety slide. In the embodiment shown, the trigger guard 120 is of linear configuration throughout the region 121 in which the safety slide is displaceable.

On the trigger guard 120 there are provided locking means which are adapted to engage corresponding locking elements 132 on the safety slide 130 and thus lock the safety slide in its first end position 122 and in its second end position 123 respectively. These locking means are in the form of indentations on the trigger guard 120. For each end position 122/123 of the safety slide 130 there are provided two indentations 126 on each side of the trigger guard 120 located opposite each other.

Two locking elements 132 an the safety slide 130 cooperate with the indentations 126 and are designed as resilient latch springs 132, to each of which a corresponding front and rear indentation 126 on the trigger guard 120 is assigned for the purpose of defining the first end position 122 and the second end position 123 of the safety slide 130 respectively. In addition, the first end position 122 is defined by a front stop edge 124 of the safety slide engaging the inner surface of the trigger guard and the second end position 123 is defined by a stop edge 125 on the trigger guard.

The safety slide 130 has a top surface 131 and is equipped with two side elements 133 fastened to its top surface 131, while the inside surface of each side element 133 features a guide rail 134 to guide the movement of the safety slide 130 along the trigger guard 120. The side elements 133 are resilient so as to make it possible to manually snap the safety slide 130 onto the trigger guard 120 and to manually remove it therefrom. The safety slide 130 features a profiled surface 135/136 thus permitting the trigger 110 to freely move in the first position 122 of the safety slide and to be blocked by the safety slide 130 in its second position 123. The surface profile of the safety slide 130 comprises a curved element 135, which is constructed such that it permits the trigger to pivot in the first end position of the safety slide 130. Furthermore, the surface profile of the safety slide exhibits a wedge-shaped portion 136, which is designed to block any pivotal movement of the trigger 110 in the second end position 123 of the safety slide 130. This wedge-shaped portion 136 of the surface is disposed between the curved surface profile 135 and the locking elements 132. Exemplary slide manufacturing may involve molding of a polymer or machining from an alloy.

The exemplary embodiment explained above merely serves the purpose of achieving better understanding of the teaching of the invention defined in the claims, which teaching is not, as such, restricted to said exemplary embodiment.

What is claimed is:

1. A trigger safety device (100) for firearms comprising a trigger (110) which is adapted for rotary reciprocation about a fulcrum (111) and whose free end is protected by a trigger guard (120), characterized in that a safety slide (130) is mounted on the trigger guard (120) for reciprocal displacement between a first end position (122) and a second end position (123) such that said trigger (110) is freely pivotal in a first end position (122) of said safety slide (130) and is blocked in a second end position (123) of said safety slide (130) and for each end position (122/123) of said safety slide (130) there are provided on said trigger guard (120) two opposing indentations (126) on opposite sides of said trigger guard (120) which cooperate with corresponding locking elements (132) on said safety slide (130) to ensure that said safety slide (130) locks in position in each of said first end position (122) and said second end position (123).

2. A device (100) as defined in claim 1, characterized in that said trigger guard (120) has a linear configuration throughout a region (121) in which said safety slide (130) is displaceable.

3. A device (100) as defined in claim 1, characterized in that a said locking element (132) on said safety slide (130) is in the form of a resilient latch spring (132).

4. A device (100) as defined in claim 1, characterized in that said second end position (123) of the safety slide (130) is defined by a stop edge (125) provided on said trigger guard (120).

5. A device (100) as defined in claim 1, characterized in that said safety slide (130) has a top surface (131) and two side elements (133) attached to said top surface (131), and an inner surface of each side element (133) there is provided a guide rail (134) to guide the movement of said safety slide (130) along said trigger guard (120).

6. A device (100) as defined in claim 5, characterized in that said side elements (133) are of a resilient nature so that said safety slide (130) can be manually snapped onto said trigger guard (120) and can be manually removed therefrom.

7. A device (100) as defined in claim 1, characterized in that said safety slide (130) has a profiled surface (131) to the effect that said trigger (110) is freely pivotal in a first end position (122) of said safety slide (130) and is blocked in a second end position (123) of said safety slide (130).

8. A device (100) as defined in claim 7, characterized in that the surface profile (131) of said safety slide (130) has a curved portion (135) of its surface, which is designed such that it permits free pivotal movement of said trigger (110) in said first end position (122) of said safety slide (130).

9. A device (100) as defined in claim 7, characterized in that said surface profile (131) of said safety slide (130) shows a wedge-shaped portion (136) of its surface, which is designed such that it blocks any pivotal movement of said trigger (110) in the second end position (123) of said safety slide (130).

10. A device (100) as defined in claim 8, characterized in that on said safety slide (130) there is disposed a wedge-shaped portion (136) of its surface between said curved portion (135) of its surface and said locking elements (132).

11. A device (100) as defined in claim 7, characterized in that on said safety slide (130) there is disposed a wedge-shaped portion (136) of its surface between a curved portion (135) of its surface and said locking elements (132).

12. A firearm comprising:

a trigger (110) having a free end;

a trigger guard (120) protecting the free end and having:

a first front indentation;

a first rear indentation;

a second front indentation; and a second rear indentation; and a safety slide (130) mounted on the trigger guard (120) for reciprocal displacement between a first position (122) permitting a firing movement of the trigger and a second position (123) blocking firing movement of the trigger, the safety slide (130) having a pair of resilient latch springs (132), a first said latch spring (132) engaged with the first front indentation in the first position and with the first rear indentation in the second position, a second said latch spring (132) engaged with the second front indentation in the first position and with the second rear indentation in the second position.

13. The firearm of claim 12 wherein:

the first and second positions are end positions; and the trigger is mounted for rotary reciprocation about a fulcrum (111).

14. A trigger safety device (100) for firearms comprising a trigger (110) which is adapted for rotary reciprocation about a fulcrum (111) and whose free end is protected by a trigger guard (120), characterized in that a safety slide (130)

is mounted on the trigger guard (120) for reciprocal displacement between a first end position (122) and a second end position (123) such that said trigger (110) is freely pivotal in a first end position (122) of said safety slide (130) and is blocked in a second end position (123) of said safety slide (130) and further comprising: a locking element (132) on said safety slide (130) is in the form of two resilient latch springs (132), and to each latch spring (132) there is assigned a respective front and rear indentation (126) on said trigger guard (120) to define said first end position (122) and said second end position (123) respectively of said safety slide (130), the latch springs and indentations cooperating to ensure that said safety slide (130) locks in position in each of said first end position (122) and said second end position (123).

* * * * *

UNITED STATES PATENT AND TRADEMARK OFFICE

CERTIFICATE OF CORRECTION

PATENT NO. : 7,377,067 B2
APPLICATION NO. : 11/409930
DATED : May 27, 2008
INVENTOR(S) : Wulf-Heinz Pflaumer et al.

It is certified that error appears in the above-identified patent and that said Letters Patent is hereby corrected as shown below:

On the title page item (75),
The inventorship listed on the cover of the patent should be corrected to read
--Wulf-Heinz Pflaumer, Franz Wonisch, and Martin Werner--.

Signed and Sealed this

Seventeenth Day of February, 2009

John Doll

JOHN DOLL
*Acting Director of the United States Patent and Trademark Office*